US005482724A

United States Patent [19]

Morici et al.

[11] Patent Number: 5,482,724

[45] Date of Patent: Jan. 9, 1996

[54] PIZZA TRAY

[75] Inventors: Alfred Morici, San Jose; Mari' A. Dudley, Carmel by the Sea, both of Calif.

[73] Assignee: Morici, Dudley Associates, Carmel By the Sea, Calif.

[21] Appl. No.: 134,603

[22] Filed: Oct. 12, 1993

[51] Int. Cl.[6] ..... B65D 81/26

[52] U.S. Cl. ..... 426/124; 426/106; 426/115; 426/127; 426/128; 229/119; 229/902; 229/906; 229/939; 428/136; 427/391

[58] Field of Search ..... 426/106, 115, 426/124, 127, 128, 130, 129; 229/119, 902, 906, 939; 428/136, 155, 156, 213; 427/389, 391

[56] References Cited

U.S. PATENT DOCUMENTS

| | | | |
|---|---|---|---|
| 2,533,773 | 12/1950 | De la Foret | 229/939 X |
| 2,918,379 | 12/1959 | Lurie | 99/174 |
| 3,026,209 | 3/1962 | Niblack et al. | 426/129 X |
| 3,040,947 | 1/1962 | Wells et al. | 426/129 X |
| 3,379,537 | 4/1968 | Brandt et al. | 426/127 X |
| 3,420,431 | 1/1969 | Donovan | 229/2.5 |
| 3,845,896 | 11/1974 | Crabtree | 229/2.5 |
| 3,915,532 | 10/1975 | Ashton | 312/351 |
| 3,938,726 | 2/1976 | Holden, Jr. et al. | 229/2.5 |
| 4,134,004 | 1/1979 | Anderson et al. | 219/387 |
| 4,321,997 | 3/1982 | Miller | 206/204 |
| 4,344,534 | 8/1982 | Sutton | 206/545 |
| 4,373,636 | 2/1983 | Hoffman | 206/551 |
| 4,441,626 | 4/1984 | Hall | 426/127 X |
| 4,576,278 | 3/1986 | Laiewski et al. | 426/106 X |
| 4,919,326 | 4/1990 | Deiger | 229/906 X |
| 4,995,557 | 2/1991 | Fremion | 229/125.29 |
| 5,094,385 | 3/1992 | Antezak et al. | 229/110 |
| 5,098,013 | 3/1992 | France et al. | 229/906 X |

*Primary Examiner*—Donald E. Czaja
*Assistant Examiner*—Milton I. Cano
*Attorney, Agent, or Firm*—Emrich & Dithmar

[57] ABSTRACT

A generally flat tray is adapted for supporting a pizza or other food item on an upper surface thereof. The tray is preferably comprised of corrugated paperboard with its upper surface having a parchment-like coating and including a plurality of linear, elongated slots arranged in a spaced manner to permit juices and liquids exuded by the pizza to flow into and be trapped within the inner corrugated portion of the tray for maintaining the pizza crust dry and crisp. Facing edges of each slot are beveled downwardly to facilitate flow of the juices and liquids into the tray's inner portion where the juices and liquids are entrapped. The parchment-like coating on the tray's upper surface draws the juices and liquids from the pizza crust and redirects heat emanating from the pizza upward back into the pizza to maintain the pizza at an elevated temperature. The tray may be used for storing and serving pizza and may be integrated in the bottom of a closed container for transport and extended storage of the pizza. While disclosed primarily for use with a pizza, this invention may be used to maintain virtually any type of food item which exudes juices and liquids in a dry, crisp condition.

14 Claims, 2 Drawing Sheets

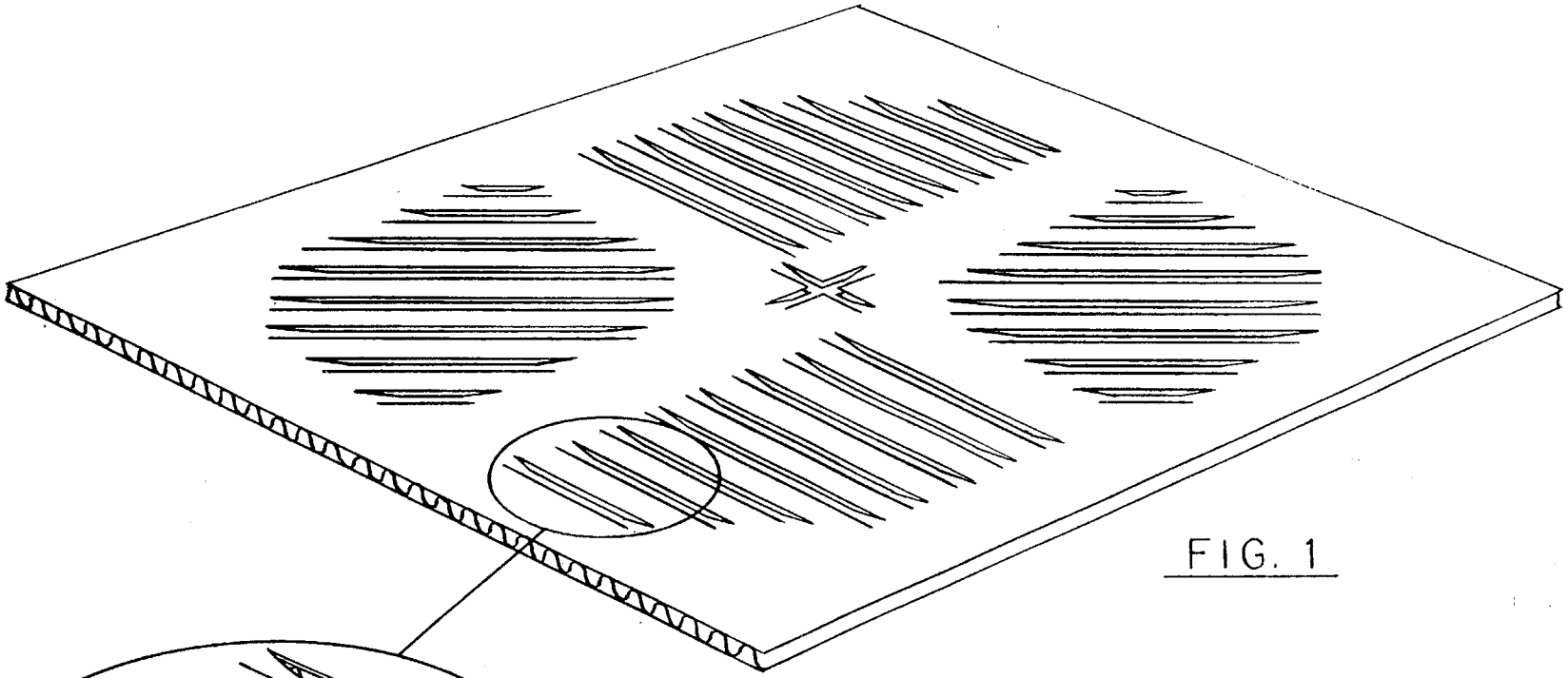
FIG. 1
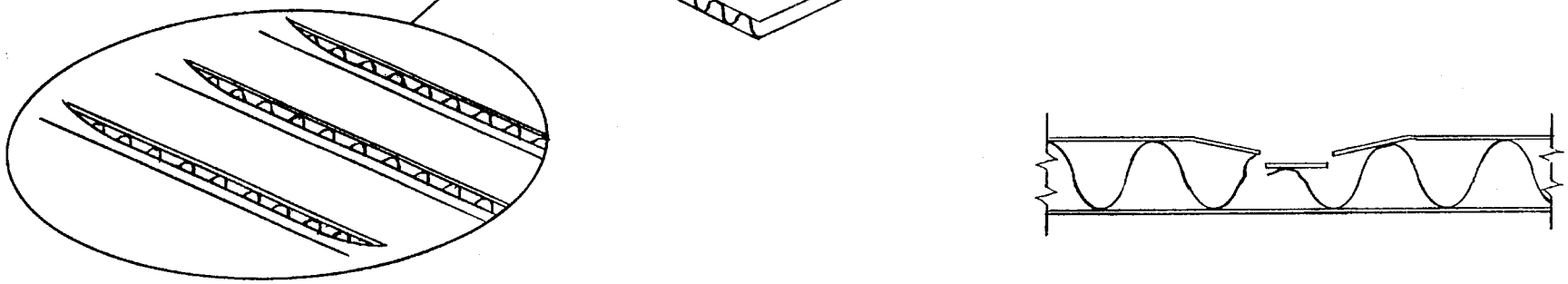
FIG. 2
FIG. 3

PIZZA TRAY

FIELD OF THE INVENTION

This invention relates generally to support trays for storing and serving pizza and other food items which characteristically exude juices and liquids, and is particularly directed to an improved pizza tray and storage container which maintains the pizza crisp and at an elevated temperature for an extended period of time.

BACKGROUND OF THE INVENTION

A closed container is generally used for the temporary storage and transport of a pizza in delivering the pizza to an ultimate consumer at a remote location. The container is generally closed and is provided with a flap or door for inserting and removing the pizza. The most common type of container is in the form of a paperboard box comprised of a single piece of corrugated paperboard and provided with an upper, pivoting cover. The paperboard container not only protects the pizza from the environment and possible contamination, but also is intended to maintain the pizza in a heated condition until delivered.

One of the problems with this type of pizza container arises from the liquids such as water and juices such as food oils which flow from the pizza onto the lower, inner surface of the paperboard container. These liquids and juices saturate the bottom of the paperboard container causing the pizza to become soggy in a relatively short period of time and adversely affecting the taste and texture of the pizza.

The prior art discloses various approaches for the temporary storage of a pizza such as during delivery. One such approach is disclosed in U.S. Pat. No. 3,938,726 which employs a tray structure having internally projecting ribs for raising the hot pizza crust to allow the escape of steam from between the pizza crust and the surface of the tray. U.S. Pat. No. 4,373,636 discloses another attempt to prevent pizza from becoming soggy by employing a tray having a plurality of spaced upward projecting ribs to provide air flow passages under a pizza to prevent the pizza from becoming soggy. Both of these approaches make use of a molded tray comprised of a solid or foamed plastic. U.S. Pat. Nos. 2,918,379 and 3,845,896 also disclose trays comprised of a molded plastic having a plurality of spaced ribs on an upper surface thereof for supporting moist food products such as meat, fish or poultry. U.S. Pat. No. 4,344,534 discloses a pizza carrier having an insulated bottom and cover, with the bottom support surface provided with a plurality of upwardly extending spacers for supporting the pizza within the carrier. One of the problems with all of the aforementioned approaches is that, while the liquids and juices flow into a space displaced from the pizza, the pizza is not separated from the juices and liquids which produce a localized moist environment which maintains the pizza in a soggy and unappetizing condition.

Finally, U.S. Pat. No. 4,321,997 discloses a food container having a pad with upper and lower plastic sheets and an inner absorbent mat. At least one of the sheets is perforated to permit the inner mat to absorb any liquids exuded by a food product positioned on the pad by capillary action. This approach is complicated and not readily adapted for low cost, mass production.

The present invention addresses the aforementioned limitations of the prior art by providing a low cost, easily manufactured and used pizza tray and enclosed pizza container which maintains the pizza dry and crisp for an extended period and conserves the pizza's heat.

OBJECTS AND SUMMARY OF THE INVENTION

Accordingly, it is an object of the present invention to provide an improved tray for storing and serving pizza.

It is another object of the present invention to maintain a pizza crispy and hot until ready for consumption by removing juices and liquids exuded by the pizza from its crust and reflecting heat radiated by the pizza back into the pizza.

Yet another object of the present invention is to provide a pizza carrier which extends the shelf-life of the pizza by maintaining the heat of the pizza within the container and preventing the pizza from becoming soggy from contact with juices and liquids exuded therefrom.

A further object of the present invention is to provide a pizza tray and carrier which are sturdy, light weight and simple in construction and of low cost and which maintains the pizza fresh for extended periods.

These objects of the present invention are achieved and the disadvantages of the prior art are eliminated by a tray for supporting pizza comprising: a generally flat support member having upper and lower spaced, planar surfaces and a corrugated inner portion disposed intermediate and engaging the upper and lower surfaces for forming a space intermediate the upper and lower surfaces and for supporting the upper surface and a pizza disposed thereon; a parchment-like coating disposed on the upper surface of the support member and engaging the pizza for drawing off juices and liquids exuded by the pizza and for re-directing heat emanating from the pizza upward back into the pizza; and a plurality of spaced slots in the upper surface of the support member for permitting the juices and liquids to flow into the space intermediate the upper and lower surfaces of the support member for maintaining the pizza dry and crisp.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 4:
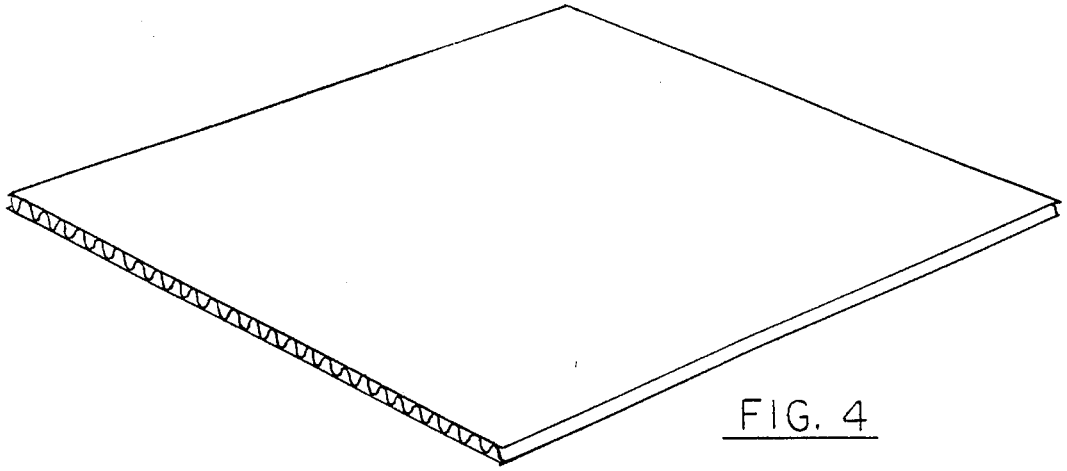
FIG. 4 is a perspective view of a lower surface of the pizza tray of the present invention.
Figure 1:
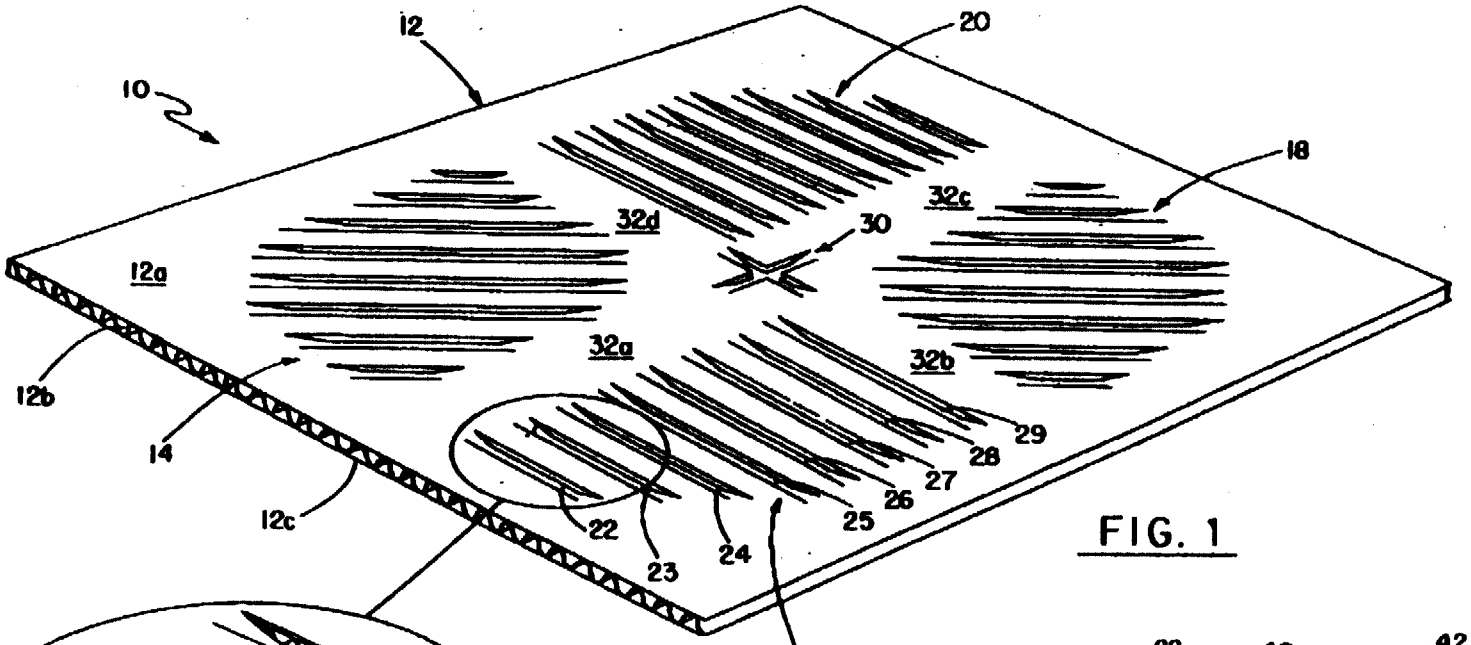
FIG. 1 is an upper perspective view of a pizza tray in accordance with the principles of the present invention.

Referring to FIG. 1, there is shown an upper perspective view of a pizza tray 10 in accordance with the principles of the present invention. The pizza tray 10 is comprised of a generally flat panel 12 having an upper surface 12*a*, a lower surface 12*c* and inner corrugations 12*b* disposed intermediate the upper and lower surfaces. A perspective view of the lower surface 12*c* of the flat panel 12 is shown in FIG. 4. Corrugations 12*b* engage the upper and lower surfaces 12*a*, 12*c* and maintain the spacing between and provide support for these surfaces. The arrangement of the upper and lower surfaces 12*a*, 12*c* and the inner corrugations 12*b* is conventional, with fluted corrugated paperboard used in the preferred embodiment of the present invention. Although the pizza tray 10 is shown as generally square in FIG. 1, it is not limited to this shape, but may assume virtually any shape such as rectangular, circular, octagonal, etc., as determined by the shape of the pizza disposed on the tray. In addition, the pizza tray 10 may be sized and shaped to support small pizzas, or even a slice of pizza, as well as very large pizzas.

Figure 2:
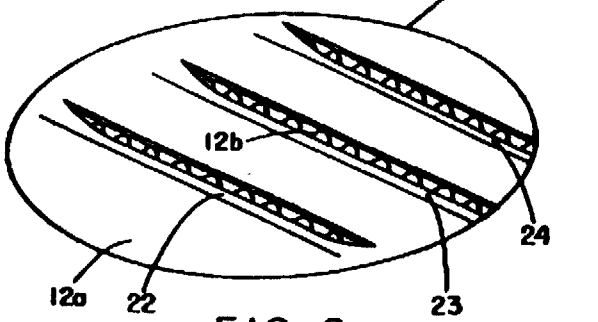
FIG. 2 is an enlarged view of a portion of the pizza tray shown in FIG. 1.

Disposed in the upper surface 12*a* of the pizza tray 10 are first, second, third and fourth arrays of slots 14, 16, 18 and 20. Each of the slot arrays 14, 16, 18 and 20 includes a plurality of generally linear, elongated slots arranged in a spaced manner, such as slots 22–29 in the second array of slots. An array of center slots 30 is disposed intermediate the first, second, third and fourth arrays of slots 14, 16, 18 and 20. Unslotted, continuous portions 32*a*, 32*b*, 32*c* and 32*d* of the tray's upper surface 12*a* are disposed intermediate the four arrays of slots of a depth which ensures that the upper surface is of sufficient strength to support a pizza (not shown in the figure for simplicity) disposed thereon. Additional details of the first three slots 22, 23 and 24 in the second array of slots 16 are shown in the enlarged perspective view of FIG. 2. In this view, the inner corrugations 12*b* can be seen through each of the three slots 22, 23 and 24 in the upper surface 12*a* of the flat panel 12. The present invention is not limited to the configuration and alignment of the slots shown in FIG. 1, but may have virtually any array and configuration of slots. For example, the slots are not limited to being linear, but may have a curvilinear shape, given the identical efficiency which results by the application of either configuration of slots. The preferred configuration of the slots is specified in accordance with the tray/base size and its rectangular, circular or multiangled shape, so as to configure the slots either linear or curvilinear, based upon the most cost effective manufacturing considerations.

Figure 3:
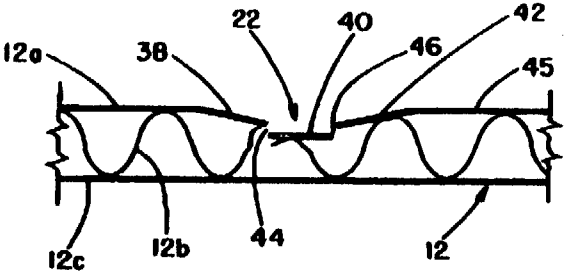
FIG. 3 is a vertical sectional view through a portion of the pizza tray of FIG. 1 illustrating details of a slot in an upper surface of the tray.
Figure 4:
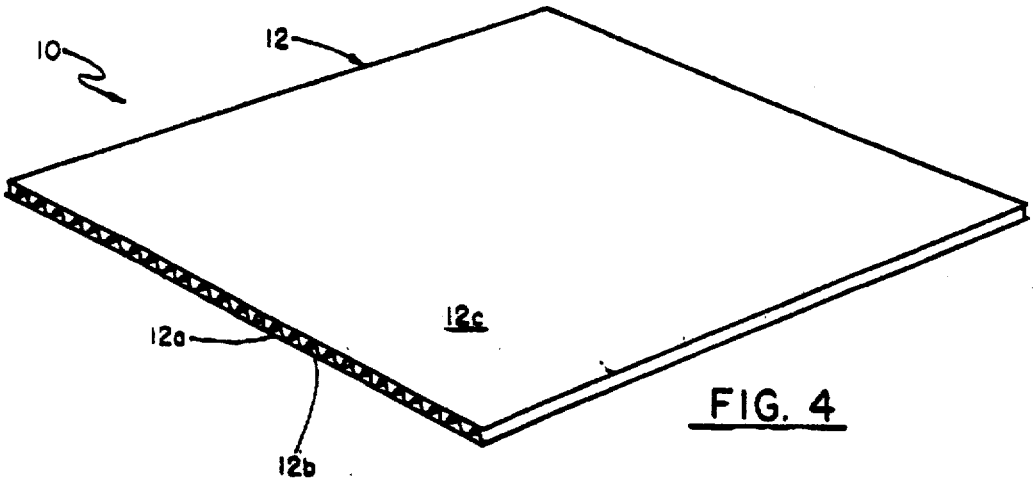
Figure 5:
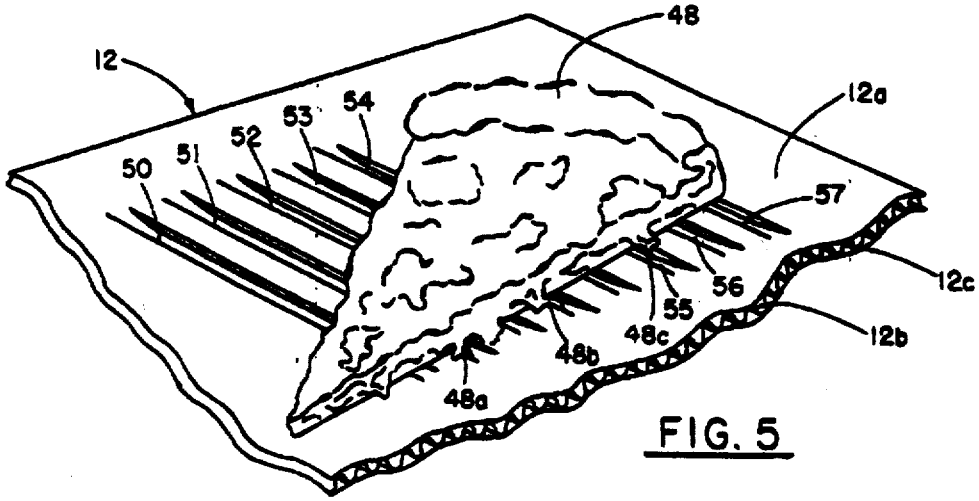
Figure 6:
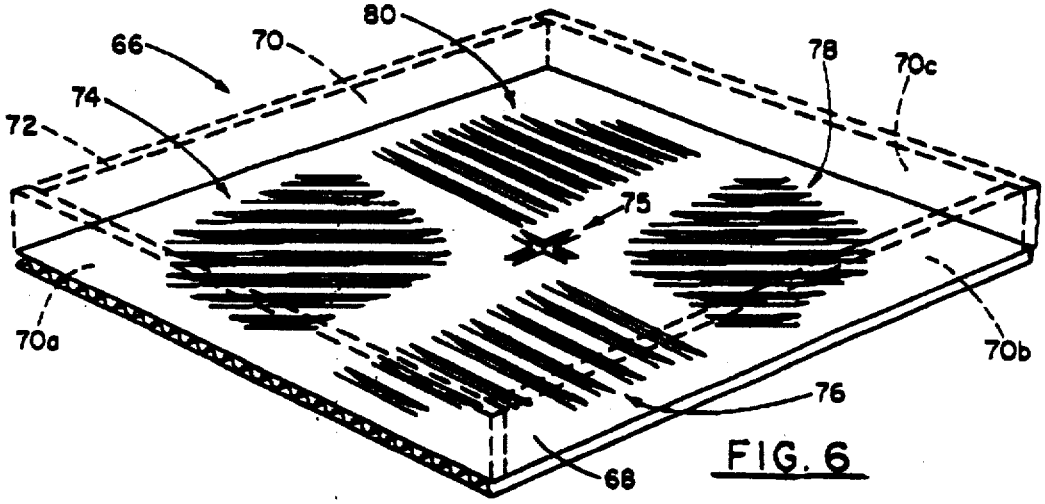

Referring to FIG. 3, there is shown a partial sectional view of a portion of the flat panel 12 adjacent slot 22 therein. As shown in the figure, in forming slot 22 two parallel, linear cuts, or incisions, are made in upper surface 12*a* so as to form first and second spaced drain channels 44 and 46. Disposed intermediate the first and second drain channels 44, 46 is an intermediate member 40 formed from the flat panel's upper surface 12*a*. Facing edges 38 and 42 of slot 22 formed from adjacent portions of the flat panel's upper surface 12*a* are angled, or beveled, downwardly to facilitate downward flow of juices and liquids from a pizza disposed on the flat panel 12. Juices and liquids exuded from a pizza disposed on the flat panel's upper surface 12*a* flow down the first and second angled edges 38, 42 and through the first and second drain channels 44 and 46 into the space between the upper and lower surfaces 12*a*, 12*c*. The juices and liquids become entrapped in the space between the upper and lower surfaces 12*a*, 12*c* and flow onto the corrugations 12*b*. Corrugations 12*b* absorb the juices and liquids and restrict them from contacting the flat panel's lower surface 12*c*. This maintains the lower surface 12*c* dry and prevents the juices and liquids from traveling through the flat panel 12 and penetrating its lower surface 12*c*. Intermediate member 40 forms a physical barrier between the pizza and the juices and liquids entrapped between the tray's upper and lower surfaces 12*a*, 12*c*. The narrow first and second drain channels 44 and 46 formed between the first and second angled edges 38, 42 and the intermediate member 40 also prevent upward flow of the juices and liquid for entrapping the juices and liquids in the space between the upper and lower surfaces 12*a*, 12*c*.

Figure 5:
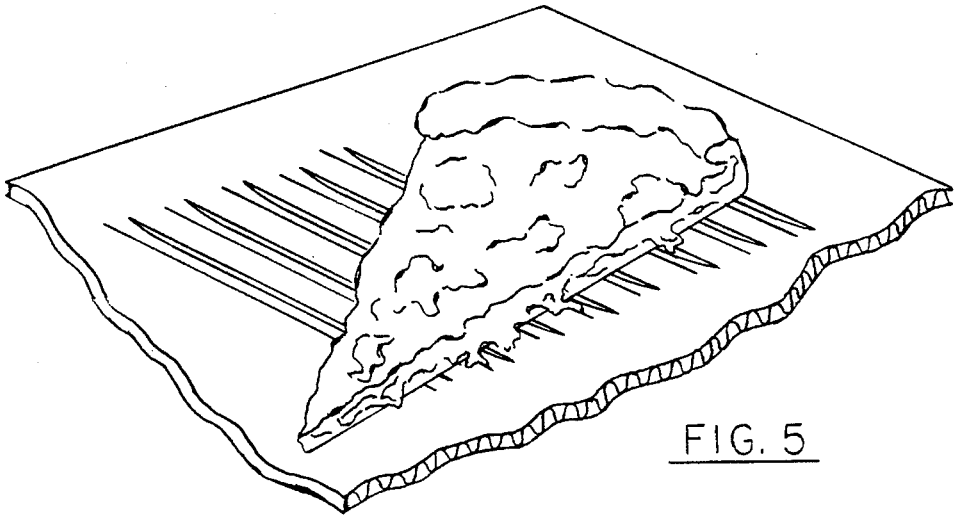
FIG. 5 is an upper perspective view of a portion of a pizza tray in accordance with the present invention showing a slice of pizza positioned on the tray.

Disposed on the outer portion of upper surface 12*a* is a thin paper-like coating 45. Coating 45 is preferably an acrylic-water solution applied to the upper surface 12*a* which dries, forming a thin layer of simulated parchment-like paper. Coating 45 in a preferred embodiment is Coating X300 available from Michelman, Inc. of Cincinnati, Ohio, or equivalent. The parchment-like coating 45 functions as a "dry" heat reflecting surface in that it reflects heat emanating from a pizza upward back into the pizza to control and direct the residual heat of the fresh baked pizza specifically to the under crust area of the pizza, so as to preserve the crisper quality of the product crust while maintaining a dry oven-like carrier box temperature. In addition, the parchment-like coating 45 deters the absorption of the juices and liquids by the upper surface and directs and controls the absorption of the juices and liquids into the patterned slots. Referring to FIG. 5, there is shown a perspective view of a portion of the pizza tray's flat panel 12, with an upper surface 12*a* thereof supporting a slice of pizza 48. The upper surface 12*a* of flat panel 12 includes a plurality of elongated, generally linear spaced slots 50–57, as previously described. The slice of pizza 48 is disposed over the slots 50–57 and exudes various portions of juices and liquids identified by element numbers 48*a* , 48*b* and 48*c*. As shown in the figure, fluid portion 48*a* flows into slot 51, while fluid portions 48*b* and 48*c* respectively flow into slots 53 and 55. As previously described, the juices and liquids flowing through each of the aforementioned slots are trapped in an inner portion of the flat panel 12 containing corrugations 12*b* disposed between the upper and lower surfaces 12*a* and 12*c*.

Figure 6:
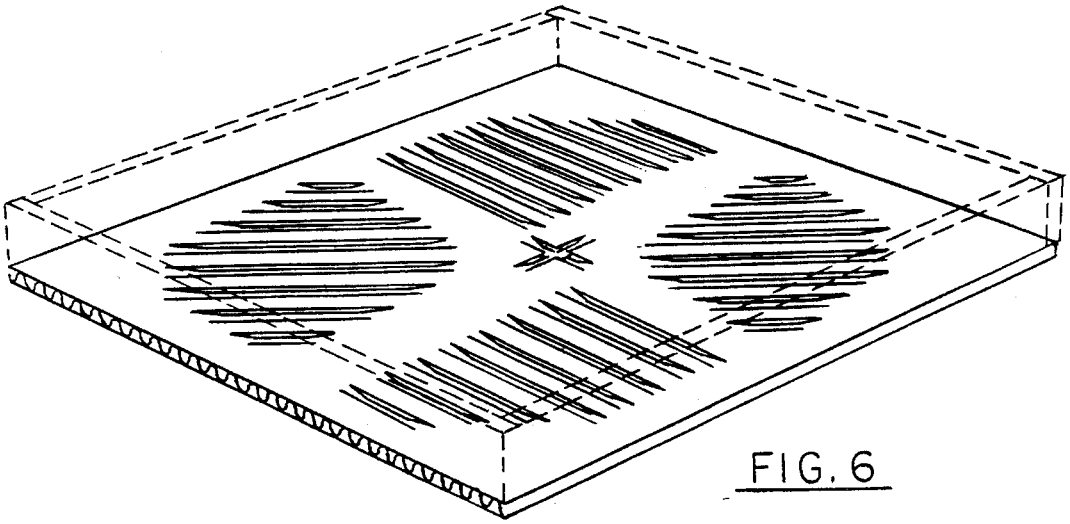
FIG. 6 is a perspective view shown partially in phantom of a pizza container in accordance with another aspect of the present invention.

Referring to FIG. 6, there is shown, partially in phantom, an upper perspective view of a closed pizza container 66 in accordance with another embodiment of the present invention. Pizza container 66 includes a generally flat lower panel comprised of a pizza tray 68 such as previously described. Pizza tray 68 includes first, second, third and fourth arrays of spaced slots 74, 76, 78 and 80 also as in the previously described embodiment. Pizza tray 68 further includes a center array of slots 75. Attached to and extending from respective lateral edges of pizza tray 68 are first, second, third and fourth container side panels 70*a*–70*d* which are shown in dotted-line form. Attached to one of the aforementioned side panels is a container top, or cover, 72. Container top 72 is pivotally attached to one of the aforementioned side panels allowing the container top to be moved downward to a closed position or to be raised to an open position to allow for access to a pizza (not shown) disposed within the pizza container 66. In a preferred embodiment, the pizza tray 68 and the sides and top of container 66 form an integral structure comprised of a corrugated paperboard as previously described. The pizza container 66 maintains a pizza disposed therein crisp and warm such as during delivery prior to consumption.

There has thus been shown a pizza tray comprised of a coated corrugated board having an upper surface with a plurality of linear, elongated slots arranged in a spaced manner to permit juices and liquids exuded by the pizza to flow into and be trapped within the inner corrugated portion of the tray for maintaining the pizza crust dry and crisp. Each of the slots includes a pair of facing, downwardly angled edges to facilitate downward flow of the juices and liquids and their entrapment within the inner corrugated portion of the board. The tray's upper surface is provided with a baking parchment-like coating which further prevents upper surface absorption of juices and liquids from the pizza crust and redirects heat emanating from the pizza crust upward back into the pizza to maintain crispness. This invention contemplates integrating the pizza tray into a one-piece, closed container for maintaining the pizza crust crisp and hot while stored and/or during delivery prior to consumption. Products in accordance with this invention are sold under the trademark PIZZA PIZZAZA®, which mark is owned by the assignee of the present application.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A tray for supporting pizza comprising:

a generally flat support member having upper and lower spaced, planar surfaces and a corrugated inner portion disposed intermediate and engaging said upper and lower surfaces for forming a space intermediate said upper and lower surfaces and for supporting said upper surface and a pizza disposed thereon;

a coating disposed on the upper surface of said support member and engaging the pizza for drawing off juices and liquids exuded by the pizza and for redirecting heat emanating from the pizza upward back into the pizza and a plurality of spaced elongated slots disposed in and extending through the upper surface and into the space intermediate the upper and lower surfaces of said support member for permitting said juices and liquids to flow into the space intermediate said upper and lower surfaces of said support member for maintaining the pizza dry and crisp wherein each of said slots includes first and second facing edges angled downwardly to facilitate drawing off the juices and liquids from the pizza and for trapping the juices and liquids in the space intermediate the upper and lower surfaces said support member, and wherein each of said slots further includes an intermediate member formed from said upper surface and disposed between said first and second facing edges of the slot and forming first and second drain channels with said first and second facing edges, respectively.

2. A tray as in claim 1 wherein said support member is comprised of fluted corrugated paperboard.

3. A tray as in claim 1 wherein each of said slots is linear in shape.

4. A tray as in claim 1 wherein said slots are arranged in a plurality of spaced arrays in the upper surface of said support member, and wherein intermediate portions of said upper surface disposed between adjacent arrays of slots provide increased support for the pizza.

5. A tray as in claim 1 wherein said coating is comprised of an acrylic-water mixture.

6. An integral container for pizza comprising:

a generally flat support member having upper and lower spaced, planar surfaces and a corrugated inner portion disposed intermediate and engaging said upper and lower surfaces for forming a space intermediate said upper and lower surfaces and for supporting said upper surface and a pizza disposed thereon;

a coating disposed on the upper surface of said support member and engaging the pizza for drawing off juices and liquids exuded by the pizza and for redirecting heat emanating from the pizza upward back into the pizza;

a plurality of spaced elongated slots disposed in and, extending through the upper surface and into the space intermediate the upper and lower surfaces of said support member for permitting said juices and liquids to flow into the space intermediate said upper and lower surfaces of said support member for maintaining the pizza dry and crisp, wherein each of said slots include first and second facing edges angled downwardly to facilitate drawing off the juices and liquids from the pizza and for trapping the juices and liquids in the space intermediate the upper and lower surfaces of said support member, and wherein each of said slots further includes an intermediate member formed from said upper surface and disposed between said first and second facing edges of the slot and forming first and second drain channels with said first and second facing edges, respectively; and a plurality of side walls extending from respective edges of said support member and a removable top panel extending from the edges of said support member for forming an enclosure about the pizza.

7. A container as in claim 6 wherein said support member is comprised of fluted corrugated paperboard.

8. A container as in claim 6 wherein each of said slots is linear in shape.

9. A container as in claim wherein said slots are arranged in a plurality of spaced arrays in the upper surface of said upper surface, and wherein intermediate portions of said upper surface disposed between adjacent arrays of slots provide increased support for the pizza.

10. A container as in claim wherein said coating is comprised of an acrylic-water mixture.

11. A tray for supporting a food product comprising:

a generally flat support member having upper end lower spaced, planar surfaces and a corrugated inner portion disposed intermediate and engaging said upper and lower surfaces for forming a space intermediate said upper and lower surfaces and for supporting said upper surface and a food product disposed thereon;

a coating disposed on the upper surface of said support member and engaging the food product for drawing off juices and liquids exuded by the food product and a plurality of spaced elongated slots disposed in and extending through the upper surface and into the space intermediate the upper and lower surfaces of said support member for permitting said juices and liquids to flow into the space intermediate said upper and lower surfaces of said support member for maintaining the food product dry and crisp, wherein said slots includes first and second facing edge angled downwardly to facilitate drawing off the juice and liquids from the food product and for trapping the juices and liquids in the space intermediate the upper and lower surfaces of said support member, and wherein each of said slots further includes an intermediate member formed from said upper surface and disposed between said first and second facing edges of the slot and forming first and second drain channels with said first and second facing edges, respectively.

12. A tray as in claim 11 wherein said support member is comprised of corrugated paperboard.

13. A tray as in claim wherein each of said slots is linear in shape.

14. A tray as in claim 11 wherein said slots are arranged in a plurality of spaced arrays in the upper surface of said support member, and wherein intermediate portions of said upper surface disposed between adjacent arrays of slots provide increased support for the food product.

* * * * *

UNITED STATES PATENT AND TRADEMARK OFFICE

CERTIFICATE OF CORRECTION

PATENT NO. : 5,482,724

DATED : January 9, 1996

INVENTOR(S) : Alfred Morici, Mari' A. Dudley

It is certified that error appears in the above-indentified patent and that said Letters Patent is hereby corrected as shown below:

| Column | Line | |
|---|---|---|
| 5 | 46 | insert --of-- after surfaces |
| 6 | 33 | insert --6- after claim |
| 6 | 39 | insert --6-- after claim |
| 6 | 42 | delete "end" and insert --and-- therefor |
| 6 | 58 | insert --each of-- after wherein |
| 6 | 59 | delete "edge" and insert --edges-- therefor |
| 6 | 60 | delete "juice" and insert --juices--therefor |
| 7 | 4 | insert --11-- after claim |

Signed and Sealed this

Twenty-first Day of May, 1996

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,482,724

DATED : January 9, 1996

INVENTOR(S) : Alfred Morici et al.

It is certified that error appears in the above-identified patent and that said Letters Patent is hereby corrected as shown below:

In the drawings,

Substitute the attached two sheets of drawings, with element identifying numerals, for the drawings printed on the patent, without element identifying numerals.

The title page, showing the illustrative figure, should be deleted and substitute therefor the attached title page.

Signed and Sealed this

Twenty-fourth Day of February, 1998

*Attest:*

Bruce Lehman

BRUCE LEHMAN

*Attesting Officer*

*Commissioner of Patents and Trademarks*

United States Patent [19]

Morici et al.

[11] Patent Number: 5,482,724

[45] Date of Patent: Jan. 9, 1996

[54] PIZZA TRAY

[75] Inventors: Alfred Morici, San Jose; Mari' A. Dudley, Carmel by the Sea, both of Calif.

[73] Assignee: Morici, Dudley Associates, Carmel By the Sea, Calif.

[21] Appl. No.: 134,603

[22] Filed: Oct. 12, 1993

[51] Int. Cl.[6] ..... B65D 81/26

[52] U.S. Cl. ..... 426/124; 426/106; 426/115; 426/127; 426/128; 229/119; 229/902; 229/906; 229/939; 428/136; 427/391

[58] Field of Search ..... 426/106, 115, 426/124, 127, 128, 130, 129; 229/119, 902, 906, 939; 428/136, 155, 156, 213; 427/389, 391

[56] References Cited

U.S. PATENT DOCUMENTS

| | | | |
|---|---|---|---|
| 2,533,773 | 12/1950 | De la Foret | 229/939 X |
| 2,918,379 | 12/1959 | Lurie | 99/174 |
| 3,026,209 | 3/1962 | Niblack et al. | 426/129 X |
| 3,040,947 | 1/1962 | Wells et al. | 426/129 X |
| 3,379,537 | 4/1968 | Brandt et al. | 426/127 X |
| 3,420,431 | 1/1969 | Donovan | 229/2.5 |
| 3,845,896 | 11/1974 | Crabtree | 229/2.5 |
| 3,915,532 | 10/1975 | Ashton | 312/351 |
| 3,938,726 | 2/1976 | Holden, Jr. et al. | 229/2.5 |
| 4,134,004 | 1/1979 | Anderson et al. | 219/387 |
| 4,321,997 | 3/1982 | Miller | 206/204 |
| 4,344,534 | 8/1982 | Sutton | 206/545 |
| 4,373,636 | 2/1983 | Hoffman | 206/551 |
| 4,441,626 | 4/1984 | Hall | 426/127 X |
| 4,576,278 | 3/1986 | Laiewski et al. | 426/106 X |
| 4,919,326 | 4/1990 | Deiger | 229/906 X |
| 4,995,557 | 2/1991 | Fremion | 229/125.29 |
| 5,094,385 | 3/1992 | Antezak et al. | 229/110 |
| 5,098,013 | 3/1992 | France et al. | 229/906 X |

*Primary Examiner*—Donald E. Czaja
*Assistant Examiner*—Milton I. Cano
*Attorney, Agent, or Firm*—Emrich & Dithmar

[57] ABSTRACT

A generally flat tray is adapted for supporting a pizza or other food item on an upper surface thereof. The tray is preferably comprised of corrugated paperboard with its upper surface having a parchment-like coating and including a plurality of linear, elongated slots arranged in a spaced manner to permit juices and liquids exuded by the pizza to flow into and be trapped within the inner corrugated portion of the tray for maintaining the pizza crust dry and crisp. Facing edges of each slot are beveled downwardly to facilitate flow of the juices and liquids into the tray's inner portion where the juices and liquids are entrapped. The parchment-like coating on the tray's upper surface draws the juices and liquids from the pizza crust and redirects heat emanating from the pizza upward back into the pizza to maintain the pizza at an elevated temperature. The tray may be used for storing and serving pizza and may be integrated in the bottom of a closed container for transport and extended storage of the pizza. While disclosed primarily for use with a pizza, this invention may be used to maintain virtually any type of food item which exudes juices and liquids in a dry, crisp condition.

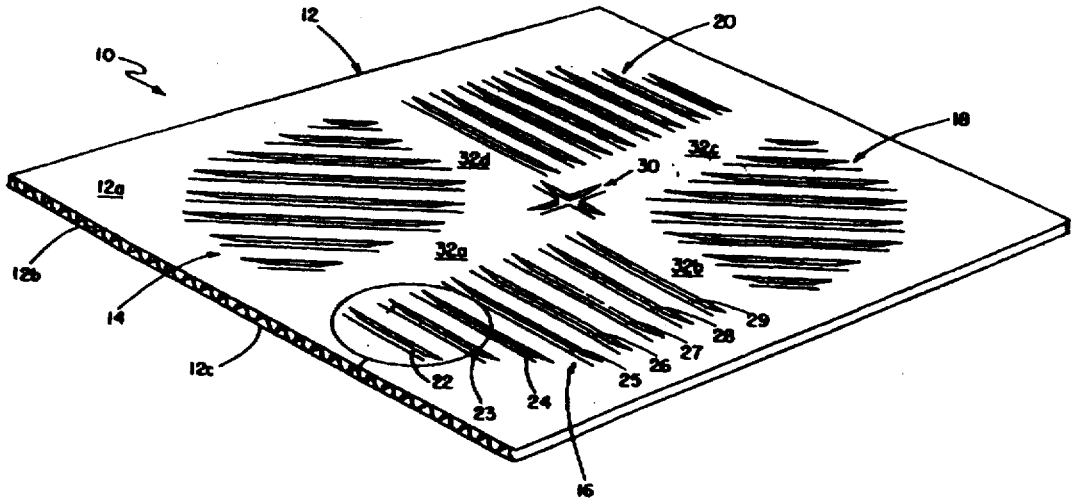

14 Claims, 2 Drawing Sheets